US005241141A

United States Patent [19]

Cominelli

[11] Patent Number: 5,241,141

[45] Date of Patent: Aug. 31, 1993

[54] ELEVATOR PROFILE SELECTION BASED ON ABSENCE OR PRESENCE OF PASSENGERS

[75] Inventor: Donald F. Cominelli, Bristol, Conn.

[73] Assignee: Otis Elevator Company, Farmington, Conn.

[21] Appl. No.: 583,931

[22] Filed: Sep. 17, 1990

[51] Int. Cl.[5] ..... B06B 1/28

[52] U.S. Cl. ..... 187/116; 187/118

[58] Field of Search ..... 187/101, 116, 118, 122, 187/127; 318/151

[56] References Cited

U.S. PATENT DOCUMENTS

| | | | |
|---|---|---|---|
| 3,561,571 | 2/1971 | Gingrich | 187/127 |
| 3,735,221 | 5/1973 | Bell et al. | 318/151 |
| 3,891,064 | 6/1975 | Clark | 187/118 |
| 4,155,426 | 5/1979 | Booker | 187/118 |
| 4,193,478 | 3/1980 | Keller et al. | 187/101 |
| 4,527,662 | 7/1985 | Doane et al. | 187/116 |
| 4,658,935 | 4/1987 | Holland | 187/122 |
| 4,751,984 | 6/1988 | Williams et al. | 187/116 |

OTHER PUBLICATIONS

G. C. Barney and S. M. dos Santos "Lift Traffic Analysis Design & Control", pub. by Peter Peregrinus Ltd. Southgate House, Stevenage, Herts. SG1 1HQ England (1977).

*Primary Examiner*—Steven L. Stephan
*Assistant Examiner*—Robert Nappi
*Attorney, Agent, or Firm*—Robert P. Hayter

[57] ABSTRACT

An elevator system including variable speed motive means is disclosed wherein the motive means is controlled in response to a selected motion profile to effect desired operation of the elevator car. Multiple elevator car motion profiles are stored and depending upon whether or not an occupant is present in the elevator car, either a comfortable high quality ride profile having an increased flight time and lower acceleration and jerk rates or a high performance profile having a decreased flight time and higher acceleration and jerk rates is selected. If no passengers are detected in the elevator car by sensing the weight of the elevator car and its occupants, and by sensing the lack of car calls, then the elevator car is free to be dispatched to a floor having a hall call at a high performance rate to minimize the flight time to reach that floor.

15 Claims, 2 Drawing Sheets

ELEVATOR PROFILE SELECTION BASED ON ABSENCE OR PRESENCE OF PASSENGERS

RELATED APPLICATIONS

This application relates to co-pending application Ser. No. 07/583,924 entitled "Elevator Motion Profile Selection" filed concurrently herewith and owned by the Assignee hereof, co-pending application Ser. No. 07/508,319 entitled "Elevator System With Varying Motion Profiles and Parameters Based on Crowd-Related Predictions" owned by the Assignee hereof and co-pending application Ser. No. 07/508,322 entitled "Automatic Selection of Different Motion Profile Parameters Based on Average Waiting Time" also owned by the Assignee hereof.

BACKGROUND OF THE INVENTION

The use of a velocity profile to control the motion of an elevator car is well known. See, for instance, U.S. Pat. No. 4,751,984 entitled "Dynamically Generated Adaptive Elevator Velocity Profile", as well as pending U.S. patent application Ser. No. 07/375,429 entitled "Elevator Speed Dictation System", both of which are owned by the Assignee hereof and both of which disclose how to generate velocity or motion profiles for an elevator car.

Motion control of an elevator car involves regulating the movement of an elevator car from an origin floor to a destination floor. Car motion may be controlled by using jerk rates, acceleration rates and deceleration rates to regulate the rate of change of acceleration and velocity to maintain the forces acting on a passenger within the car within a subjective comfort zone. A typical motion profile also includes a maximum desired speed which the elevator car will attain during longer floor runs, also known as the contract speed. A feedback loop is often used to regulate the car motion throughout the run and particularly as the car decelerates to a stop as it approaches the destination floor.

Designers of elevator systems have typically preselected a motion profile for each elevator system. This motion profile represents a compromise between fast flight times and increased capacity as opposed to slow flight times and increased comfort. The profile selected for each elevator might vary depending upon the particular market where the elevator would be installed and the expectations of customers on a desired comfort level and the need for faster service. For instance, Far Eastern passengers prefer a motion profile with relatively slow jerk and acceleration rates such that a smoother, more comfortable ride is obtained and are more willing to wait longer for the elevator car to arrive than other passengers. The typical North American passenger is less concerned with comfort and is more concerned with fast flight times and decreased waiting time and, therefore, would prefer to have the elevator car operated at a faster profile with slightly less passenger comfort due to the higher acceleration and jerk rates.

In the past the motion profile selected to operate the elevator car did not vary dependent upon whether or not passengers were in the car. Hence, the motion profile selected would have appropriate jerk and acceleration rates for a smooth passenger ride even if no passengers were in the car and, consequently, the elevator car would take longer to get from the origin floor to the destination floor than it would if it were immediately operated at the highest available acceleration and jerk rates to accelerate to contract speed. Hence, it is possible to increase overall elevator system capacity and to reduce the average waiting time of the passenger for an elevator car by operating the elevator car when there are no passengers in the elevator car at a faster motion profile resulting in a reduced flight time.

The selection of a motion profile may be based on various means of determining whether or not a passenger is present in the elevator car. Loadweighing may be utilized to sense the load in the car. Also, whether or not any car calls have been entered by pressing the buttons in the car operating panel within the elevator car is also indicative of whether or not passengers are present. Furthermore, whether or not passengers are present is only a determination which may be delayed until after the elevator car is committed to move to another floor to pick up passengers. During those periods when it is determined that the elevator car is empty, a faster motion profile (motion profile with a higher acceleration, jerk and deceleration rates) is used to reduce the flight time between the floors. During periods when a passenger is detected in the elevator, a slower motion profile (motion profile with lower acceleration, jerk and deceleration rates) is selected which provides the desired elevator performance while maintaining a comfortable ride. As used herein, the flight time is that time period extending from the closing of the elevator doors at the origin floor until the opening of the elevator doors at the destination floor.

Overall elevator system performance may be improved by operating the elevator car under a motion profile which maintains passenger comfort when passengers are present and by operating the elevator car under a high performance profile with higher acceleration and jerk rates to reduce elevator flight time when there are no passengers in the elevator car.

SUMMARY OF THE INVENTION

The present invention concerns an elevator control system for controlling the movement of an elevator car powered by variable speed motive means. This control system includes means for storing various elevator car motion profiles, each stored profile defining a desired car motion between the floors and including a high performance profile and an improved ride quality profile. Additionally included is means for selecting among the stored profiles, said means for acting to select the high performance profile when an elevator car is not occupied with passengers thereby allowing for a faster elevator flight time from floor to floor and to select an improved ride quality profile when the elevator car is occupied with at least one passenger and a slower flight time from floor to floor is desired.

Also disclosed is an elevator control subsystem for enhancing elevator response to selected calls in an elevator system having at least one elevator car serving a plurality of floors in the building. Means are provided for selecting motion profiles by generatinq signals indicative of at least two different sets of car motion profiles, said profiles effecting the amount of time it takes an elevator car to travel from one location to another location. Signal processing means associated with said motion profile selection means receive signals indicative that the elevator car is occupied with passengers and selects a more comfortable ride motion profile in response thereto. When signals are received indicative that the elevator car is not occupied, then a faster motion profile is selected.

Further disclosed is a method of increasing the performance of an elevator system having an elevator car serving a plurality of floors in a building. The method includes storing a series of motion profiles which are used to regulate the amount of time it takes an elevator car to travel between locations, determining if the elevator car is occupied, and selecting among the motion profiles based on whether the elevator car is occupied as indicated by the step of determining.

These and other objects of the present invention will become more apparent in light of a detailed description of the preferred embodiment and the accompanying drawings.

DESCRIPTION OF THE PREFERRED EMBODIMENT

Figure 1:
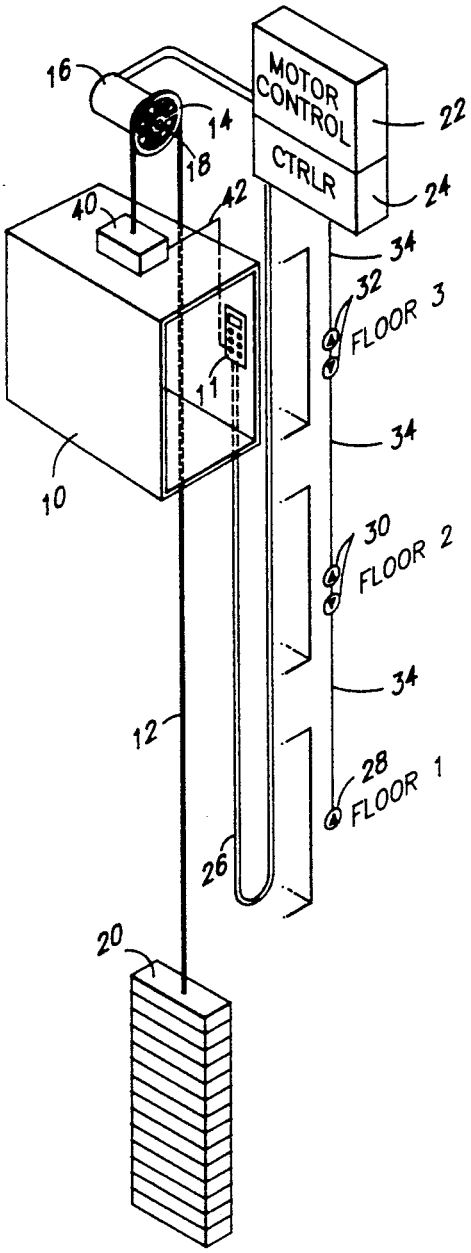
FIG. 1 PRIOR ART
FIG. 1 is a schematic representation of an elevator system.

Referring first to FIG. 1, a schematic representation of an elevator system is shown with elevator car 10 mounted within a shaftway (not shown) for vertical displacement. Elevator car 10 is connected by rope 12 over sheave 14 extending behind car 10 to counterweight 20. Motor 16 acts to control the rotation of drive shaft 18 on which sheave 14 is mounted. Operation of motor 16 effects rotation of sheave 14 thereby causing the elevator car and counterweight to be displaced in a vertical direction. Load cell 40 is connected between rope 12 and car 10 to sense the load of the car including its occupants.

Motor control 22, sometimes referred to as the drive in the elevator industry, includes the appropriate power electronics for supplying power to the motor to cause the motor to rotate at selected acceleration, jerk and velocity levels to cause the elevator car to move or be displaced in the desired manner. Appropriate electrical characteristics of the power supplied by the motor are generated via motor control 22.

Controller 24 contains the logic signal processing means to regulate elevator system operation. A car operating panel 11 mounted within the elevator car is connected by wire 42 to load cell 40 and to controller 24 via travelling cable 26 extending from the elevator car to the controller. Hall call buttons 28, 30, and 32 are arranged on floors 1 through 3 and are all connected via serial link 34 to controller 24. Controller 24 typically contains a programmed microprocessor which receives data indicative of the status of the various buttons in car operating panel 11, data on the load detected by load cell 40 and the status of the hall call buttons and is capable of utilizing this information in a variety of control functions. The software necessary to operate the elevator is stored in the controller including software which may generate various velocity profiles. See U.S. Pat. No. 4,751,984 entitled "Dynamically Generated Adaptive Elevator Velocity Profile" for specific examples of how to generate such profiles.

Figure 2:
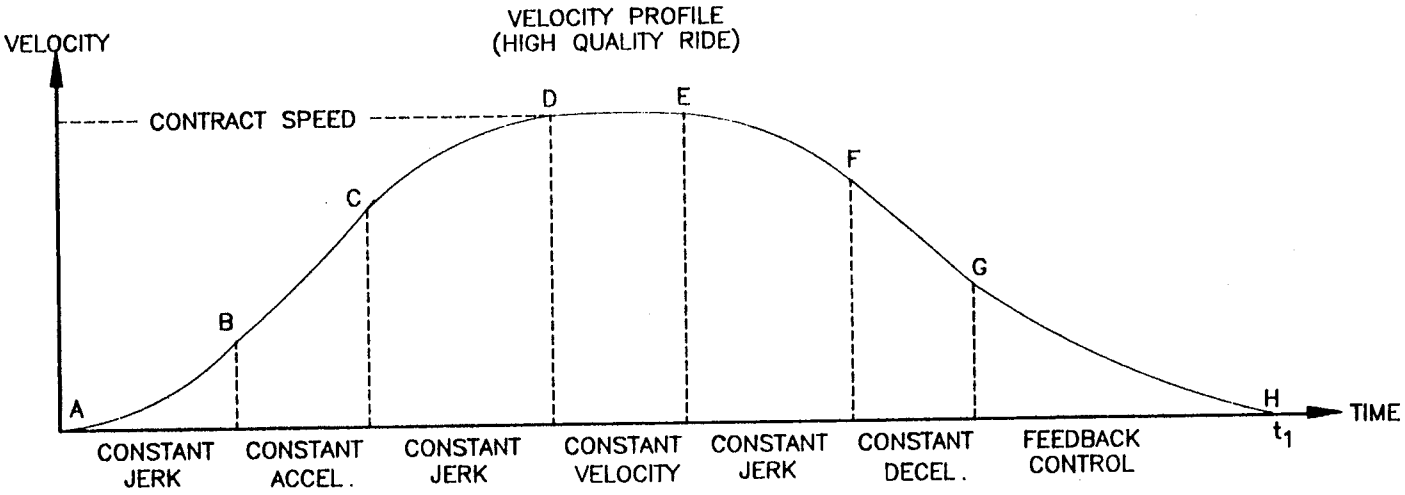
FIG. 2 is graph of an exemplary high ride quality profile.

FIG. 2 shows an exemplary velocity profile and is a graph with velocity plotted on the vertical axis and time on the horizontal axis. This profile is chosen to depict flight of an elevator car from an origin floor to a destination floor and it is assumed that the flight is long enough that the elevator car reaches contract speed for some indefinite period time. Since the contract speed will not vary with the chosen motion profile, it is shown as a line of finite length, however, the elevator car may travel at the contract speed for varying lengths of time depending on the distance travelled between the origin floor and the destination floor.

In FIG. 2 there is indicated a portion of the curve from point A, when the elevator car is just leaving the origin floor, to point B. This portion from A to B may be a constant jerk portion wherein the rate of change of acceleration or jerk is maintained constant. Thereafter, from point B to point C there is depicted a constant acceleration portion of the profile where the elevator car continues to accelerate at a constant rate. From point C to point D there is depicted another constant jerk portion where the rate of change of acceleration is maintained constant until point D at which point the elevator has reached its contract speed or maximum velocity. The elevator travels at constant velocity for the period depicted by the line from point D to point E, point E being where the car begins to decelerate to stop at its destination floor. The portion of the graph from E to F depicts a constant jerk portion of the profile wherein the elevator car is decelerated at a constantly changing rate to point F. From point F to point G there is depicted a constant deceleration zone indicating the elevator car is decelerated at a constant rate. From point G to point H the elevator car continues to decelerate until it arrives at the destination floor. Many ways are utilized to coordinate the slowing of the elevator car as it approaches the destination floor such that the elevator car may stop within a very narrow range adjacent the floor. Typically, a feedback control of some nature is utilized to sense the exact position of the car and to effect stopping the car at the desired point.

Figure 3:
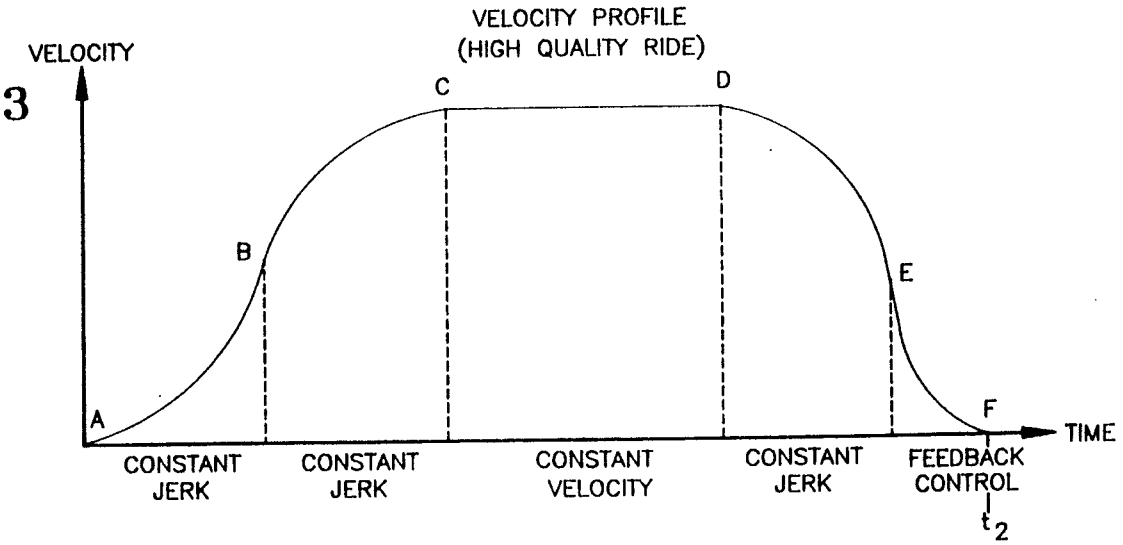
FIG. 3 is a graph of a velocity profile for an exemplary high performance profile.

FIG. 3 is a graph of a velocity profile for a high performance motion profile. This motion profile as shown has a constant jerk portion from point A to point B and a constant jerk portion from point B to point C. In the area from A to B, the rate of change of acceleration is continuously positive, and in the area from B to C the rate of change of acceleration is continuously negative such that a change in acceleration is maximized to achieve the contract velocity at point C as rapidly as possible.

From point C to point D the elevator car travels at its contract or maximum velocity. Point D is the point when the car must commence to decelerate to stop at the destination floor. The area from point D to point E is at constant negative jerk portion to cause a change to decelerate the elevator car. From point E to point F is continued deceleration portion at a positive jerk rate such that as the car arrives at the destination floor, it will stop at the correct position. Additionally, feedback control is provided in area E and F to appropriately sense the exact location.

It should be noted in a comparison to FIGS. 2 and 3 that in FIG. 3 the length of time the car operates at constant velocity is increased and, consequently, the flight time of the car as it travels from the origin floor to the destination floor is decreased. To maximize this length of time the car operates at contract or maximum velocity, the initial period of constant jerk and the portion from point B to point C of constant negative jerk are both maximized to cause the car to accelerate as rapidly as possible to contract velocity. In like manner from point D to point E and point E to point F, the rate of jerk and the slope of the line indicating the change in velocity are significantly higher than that of FIG. 2. Consequently, if a passenger were on board an elevator car operating in accordance with FIG. 3, he might experience a ride of lesser quality due to the rapid change in velocity of the elevator car. Whereas the motion profile shown in FIG. 2 is chosen to be a compromise between achieving minimum flight times and a ride having appropriate levels of passenger comfort.

Figure 4:
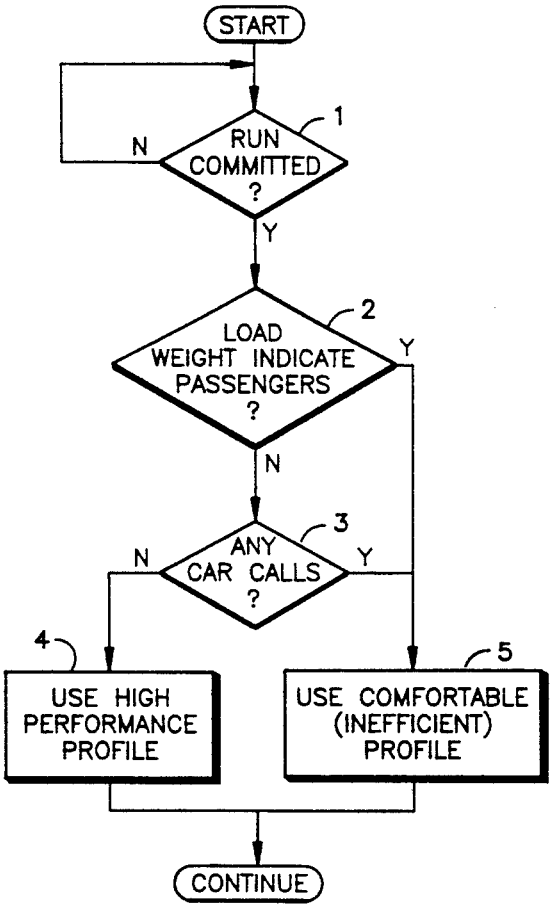
FIG. 4 is a flow chart depicting the logic involved in the selection between velocity profiles.

Referring now to FIG. 4 there may be seen a logic flow chart for implementing a computer program to select which profile should be used. Beginning at the top of the chart which is marked "Start", the logic flows to Box 1 to ask the logic question "Is a run committed?". This question means is the elevator car and its dispatching system committed to moving from one floor to another. If the answer is "No", the logic continues in a loop until the answer is "Yes". If the answer is "Yes", the logic flows to block 2 and asks the logic question "Does the load weight indicate passengers are present?". If the answer to the logic question in block 2 is "Yes", the logic flows to block 5 and the comfortable profile is selected. If the answer to the logic question in block 2 is "No", the logic flow is then to block 3 and the question of "Are there any car calls?" is asked. If the answer to the question in block 3 of whether there are any car calls is "Yes", the logic flows to block 5 and again the comfortable profile is utilized. If the answer to logic question in block 3 is "No", the logic flows to block 4 and the high performance profile is utilized. From blocks 4 and 5 the logic flow continues through the remainder of the elevator control program.

The run committed question in logic block 1 is utilized merely to establish that the elevator car will be moving from one floor to another. Until the run is committed the number of occupants, if any, in the elevator car may change. If the car is not moving, a motion profile need not be selected. In logic block 2 the question of whether the load in the car is indicative of passengers is asked to determine if the car is occupied or not. If the car is occupied or if there is additional weight above and beyond that of the car itself, it is desirable not to operate the car at the high performance profile which may be uncomfortable to passengers. Consequently, if the loadweighing device does indicate that passengers are present, then the comfortable profile having lower acceleration and jerk rates is utilized.

Even if there are no passengers indicated to be present by the loadweighing means, the logic flow additionally asks the question of whether or not there are any car calls. Car calls are entered when a person pushes a button within the elevator car indicative of a destination floor. If there are car calls, then it is assumed that there is a passenger in the elevator car even if the loadweighing device does not detect additional load. In any event, if a car call button is pushed, the more comfortable profile is used. If the loadweighing indication device indicates there is no additional load and there are no car call buttons pushed, then upon operation of the elevator car the high performance profile will be utilized to cause the car to travel more quickly from the origin floor to the destination floor where presumably it will pick up a passenger.

In the manner described we have seen the elevator car may be operated more quickly to travel unoccupied to a destination floor to pick up a waiting passenger. In this manner the overall performance of the elevator system may be increased by allowing operation which would be less comfortable to the passenger to be utilized when there are no passengers in the elevator car.

It is naturally to be understood that this means of choosing between motion profiles requires that the elevator car be capable of being operated at various speeds. This invention has applicability to gearless and geared elevator systems as well as hydraulic and linear induction motor elevator systems or any other type of elevator system having a varying motion profile.

It is also to be anticipated that this idea has particular application to those portions of the world, such as, the Far East, wherein the comfort of the ride is paramount to waiting time. In these areas the acceleration and jerk rates of the motion profile are selected to be minimized to provide for the highest comfort ride. Consequently, the flight time the elevator car from the origin floor to the destination floor is increased. Additional performance will be obtained in areas utilizing a relatively slow motion profile by the use of the high performance profile when no passengers are present because the change in waiting time for a passenger awaiting an elevator car will be reduced significantly more than in those areas where the motion profile for an occupied passenger car is not that much different from the high performance profile. In other words, the time savings is maximized when the comfortable ride quality profile requires flight times significantly longer than that of the high performance profile.

The above invention has been described with reference to a particular embodiment. It is understood by those skilled in the art that variations and modifications can be effected within the spirit and scope of the invention.

I claim:

1. An elevator control system for controlling the movement of an elevator car powered by a variable speed motive means which comprises:

means for storing various elevator car motion profiles, each stored profile defining a desired car motion between floors and including a high performance profile and an improved ride quality profile; and means for selecting among the stored profiles, said means for selecting acting to select the high performance profile when an elevator car is not occupied with a passenger thereby allowing a faster elevator flight time from floor to floor and to select the improved ride quality profile when the elevator car is occupied with a passenger and a slower flight time from floor to floor is desired.

2. The elevator control system as set forth in claim 1 wherein the means for selecting further comprises means for determining if the elevator car is occupied.

3. The elevator control system as set forth in claim 2 wherein the means for determining if the elevator car is occupied comprises a load sensor for sensing the load in the car.

4. The elevator control system as set forth in claim 3 wherein the means for determining if an elevator car is occupied further comprises means for determining if any car calls are registered in the elevator car.

5. The elevator control system as set forth in claim 4 wherein the means for determining if an elevator car is occupied further comprises means for determining if the elevator car has been committed to travel to another floor.

6. The elevator control system as set forth in claim 2 wherein the means for selecting chooses the high performance profile when the means for determining if the elevator car is occupied senses no load in the car and no car calls are registered in the car.

7. The elevator control system as set forth in claim 1 wherein the car motion profiles further comprise means for defining acceleration, jerk and deceleration rates of the motion of the car between floors.

8. An elevator control subsystem for enhancing elevator response to selected calls in an elevator system having at least one elevator car serving a plurality of floors in a building which comprises:

motion profile selection means for generating signals indicative of at least two different sets of car motion profiles which effect the amount of time it takes the elevator car to travel from one location to another location; and signal processing means associated with said motion profile selection means for receiving signals indicative that the elevator car is occupied with passengers and selecting a speedier motion profile when the signals indicative that the elevator car is occupied are not detected and selecting a slower motion profile when signals indicative that the elevator car is occupied are detected.

9. The elevator control subsystem as set forth in claim 8 including load sensors for determining changes in weight of the elevator car and wherein a signal indicative that the elevator car is occupied further comprises a load signal generated by the load sensor.

10. The elevator control subsystem as set forth in claim 9 wherein the elevator has buttons for registering car calls and wherein a signal indicative that the elevator car is occupied further comprises monitoring to see if any car calls are registered in the elevator.

11. A method of increasing the performance of an elevator system having an elevator car serving a plurality of floors in a building which comprises the steps of:

storing a series of motion profiles which are used to regulate the amount of time it takes the elevator car to travel between locations including a high performance profile and an improved ride quality profile;

determining if the elevator car is occupied; and selecting the high performance profile when the elevator car is not occupied and selecting the improved ride quality profile when the elevator car is occupied as indicated by the step of determining.

12. The method as set forth in claim 11 wherein the elevator system includes load sensors connected to generate a signal indicative of the elevator car load and wherein the step of determining further comprises:

sensing the elevator car load.

13. The method as set forth in claim 12 wherein the step of sensing the elevator car load comprises sensing the load of the elevator car and determining when the load sensed is indicative of an elevator car without occupants.

14. The method as set forth in claim 12 wherein the elevator car includes call buttons for registering car calls and wherein the step of determining if the elevator car is occupied further comprises sensing if any car calls have been registered.

15. The method as set forth in claim 14 and further comprising the step of detecting a commitment for the elevator car to be displaced and wherein the step of selecting is only initiated after the step of detecting indicates such a commitment.

* * * * *